US010130121B2

(12) United States Patent
Plojoux et al.

(10) Patent No.: US 10,130,121 B2
(45) Date of Patent: Nov. 20, 2018

(54) METHOD AND APPARATUS FOR CLEANING A HEATING ELEMENT OF AEROSOL GENERATING DEVICE

(71) Applicant: PHILIP MORRIS PRODUCTS S.A., Neuchatel (CH)

(72) Inventors: Julien Plojoux, Geneva (CH); Olivier Greim, Villars-Burquin (CH)

(73) Assignee: Philip Morris Products S.A., Neuchatel (CH)

( * ) Notice: Subject to any disclaimer, the term of this patent is extended or adjusted under 35 U.S.C. 154(b) by 419 days.

(21) Appl. No.: 14/369,838

(22) PCT Filed: Dec. 28, 2012

(86) PCT No.: PCT/EP2012/077093
§ 371 (c)(1),
(2) Date: Jun. 30, 2014

(87) PCT Pub. No.: WO2013/098411
PCT Pub. Date: Jul. 4, 2013

(65) Prior Publication Data

US 2015/0282525 A1 Oct. 8, 2015

(30) Foreign Application Priority Data

Dec. 30, 2011 (EP) ..... 11196235

(51) Int. Cl.
*A24F 3/02* (2006.01)
*A24F 47/00* (2006.01)
(Continued)

(52) U.S. Cl.
CPC ..... *A24F 3/02* (2013.01); *A24F 9/04* (2013.01); *A24F 47/008* (2013.01);
(Continued)

(58) Field of Classification Search
None
See application file for complete search history.

(56) References Cited

U.S. PATENT DOCUMENTS 2,104,266 A * 1/1938 McCormick ..... A24F 47/008 131/175
5,144,962 A 9/1992 Counts et al.
(Continued)

FOREIGN PATENT DOCUMENTS

CN 1209731 A 3/1999
CN 201067079 Y 6/2008
(Continued)

OTHER PUBLICATIONS

Chinese Office Action with English translation dated Jun. 27, 2016 in corresponding Chinese Patent Application No. 201280065324.2, (18 pages).
(Continued)

*Primary Examiner* — Michael J Felton
(74) *Attorney, Agent, or Firm* — Oblon, McClelland, Maier & Neustadt, L.L.P.

(57) ABSTRACT

A method of using an aerosol-generating device is provided, including bringing a heating element of the aerosol-generating device into contact with an aerosol-forming substrate, raising a temperature of the heating element to a first temperature to heat the aerosol-forming substrate sufficiently to form an aerosol, removing the heating element from contact with the aerosol-forming substrate and heating the heating element to a second temperature, higher than the first temperature, to thermally liberate organic materials adhered to or deposited on the heating element. An aerosol-generating device is also provided, including a heating
(Continued)

element coupled to a controller configured to heat the heating element to the first temperature and to the second temperature.

9 Claims, 3 Drawing Sheets

(51) Int. Cl.
*A24F 9/04* (2006.01)
*B08B 7/00* (2006.01)
*H05B 1/02* (2006.01)

(52) U.S. Cl.
CPC ..... *B08B 7/0085* (2013.01); *H05B 1/0244* (2013.01); *H05B 2203/021* (2013.01)

(56) References Cited

U.S. PATENT DOCUMENTS

| | | | | |
|---|---|---|---|---|
| 5,249,586 | A | 10/1993 | Morgan et al. | |
| 5,505,214 | A * | 4/1996 | Collins | A24F 47/008 128/202.21 |
| 5,573,692 | A | 11/1996 | Das et al. | |
| 5,878,752 | A * | 3/1999 | Adams | A24F 47/008 131/194 |
| 2004/0149297 | A1 | 8/2004 | Sharpe | |
| 2004/0149737 | A1 | 8/2004 | Sharpe et al. | |
| 2007/0102013 | A1 | 5/2007 | Adams et al. | |
| 2010/0163063 | A1 | 7/2010 | Fernando et al. | |
| 2010/0313901 | A1 | 12/2010 | Fernando et al. | |

FOREIGN PATENT DOCUMENTS

| | | | |
|---|---|---|---|
| EP | 0 897 271 | A1 | 2/1999 |
| EP | 2 201 850 | A1 | 6/2010 |
| EP | 2 253 233 | A1 | 11/2010 |
| JP | 5-115272 | A | 5/1993 |
| JP | 7-184627 | | 7/1995 |
| JP | 2009-509523 | A | 3/2009 |
| JP | 2012-513750 | A | 6/2012 |
| JP | 2012-527222 | A | 11/2012 |
| KR | 10-1999-0081973 | A | 11/1999 |
| KR | 10-0636287 | B1 | 10/2006 |
| RU | 2 091 283 | C1 | 9/1997 |
| RU | 2 191 529 | C1 | 10/2002 |
| WO | WO 97/48293 | A1 | 12/1997 |
| WO | WO 98/23171 | A1 | 6/1998 |
| WO | 2007/042941 | A2 | 4/2007 |
| WO | WO 2011/050964 | A1 | 5/2011 |
| WO | WO 2012/065754 | A2 | 5/2012 |

OTHER PUBLICATIONS

Notice of Allowance dated Sep. 28, 2016 in Japanese Patent Application No. 2014-549500 (with English translation).
Office Action dated Nov. 9, 2016 in Taiwanese Patent Application No. 101150963 (with English translation).
International Search Report and Written Opinion of the International Searching Authority dated May 27, 2013, in PCT/EP2012/077093, filed Dec. 28, 2012.
Combined Chinese Office Action and Search Report dated Nov. 3, 2015 in Patent Application No. 201280065324.2 (with English language translation).
Russian Notice of Allowance with English language translation dated Mar. 10, 2017 in the corresponding Russian Patent Application No. 2014131458, (13 pages).
Korean Office Action issued Dec. 1, 2016 in patent application No. 10-2014-7016443 with English translation.
Korean Office Action with English language translation dated Apr. 27, 2017 in corresponding Korean Patent Application No. 10-2014-7016443, (9 pages).
Notice of Allowance dated Oct. 23, 2017, in Japanese Patent Application No. 2016-229991 (with English translation).
"Cleaning Atomizer & Cleaning Cycle Bad Taste Tips," www.e-cigarette-forum.com, accessed/printed Aug. 11, 2017 (3 pages).
"Something Weird Just Happened," www.e-cigarette-forum.com, accessed/printed Aug. 11, 2017 (5 pages).
"Dry Burning—What and Why?", forums.aussievapers.com, accessed/printed Aug. 11, 2017 (4 pages).
"Heating Coil as Clean Method-Pics and a New Discovery," www.e-cigarette-forum.com, accessed/printed Aug. 11, 2017 (7 pages).
"My Atty Resurrection Method," www.e-cigarefte-forum.com, accessed/printed Aug. 11, 2017 (7 pages).
"Frequently Asked Questions," www.bestsmokeanywhere.com, accessed/printed Aug. 11, 2017 (3 pages).
"How to Clean an Atomizer," vapegrl.com, accessed/printed Aug. 11, 2017 (3 pages).
"E-Cigarette FAQ," www.ecgis-shop.com, accessed/printed Aug. 11, 2017 (9 pages).
European Search Report dated Mar. 22, 2018, issued in European Patent Application No. 17203415.9.
Office Action dated Jun. 27, 2018 in Korean Patent Application No. 10-2017-7034140 (submitting English language translation only), (4 pages).

* cited by examiner

METHOD AND APPARATUS FOR CLEANING A HEATING ELEMENT OF AEROSOL GENERATING DEVICE

CROSS REFERENCE TO RELATED APPLICATION

This application is a national phase application based on PCT/EP2012/077093, filed on Dec. 28, 2012.

The present specification relates to a method of using an aerosol-generating device having a reusable heating element and to an aerosol-generating device comprising a heating element for use in the consumption of a smoking article.

Smoking articles in which an aerosol-forming substrate, such as a tobacco containing substrate, is heated rather than combusted are known in the art. The aim of such heated smoking articles is to reduce known harmful smoke constituents produced by the combustion and pyrolytic degradation of tobacco in conventional cigarettes. Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the consumer.

A number of prior art documents disclose aerosol-generating devices for consuming or smoking heated smoking articles. Such devices include, for example, heated smoking systems and electrically heated smoking systems. One advantage of these systems is that they significantly reduce sidestream smoke, while permitting the smoker to selectively suspend and reinitiate smoking. An example of a heated smoking system is disclosed in U.S. Pat. No. 5,144,962, which includes in one embodiment a flavour-generating medium in contact with a heater. When the medium is exhausted, both it and the heater are replaced. An aerosol-generating device where a smoking article can be replaced without the need to remove the heating element is desirable.

Typically, smoking articles for use with aerosol-generating devices comprise an aerosol-forming substrate that is assembled, often with other elements or components, in the form of a rod. Typically, such a rod is configured in shape and size to be inserted into an aerosol-generating device that comprises a heating element for heating the aerosol-forming substrate.

Other aerosol-generating devices, such as the electrical lighter disclosed in U.S. Pat. No. 5,878,752, use a sleeve, e.g., ceramic or metal, surrounds the heater fixture, and a resistive heating element is in thermal proximity with the sleeve. In conjunction with the sleeve-type heater, a cleaning element is optionally inserted into the cigarette receptacle of the electrical lighter or placed at the exit thereof to absorb, attract and/or catalytically break down the thermally liberated condensates. In such systems, the cigarette heater fixture may be defined by blades that concentrically surround an inserted cigarette.

In contrast to such systems, direct contact between a heating element, for example an electrically actuated heating element, and the aerosol-forming substrate may provide an efficient means for heating the aerosol-forming substrate to form an inhalable aerosol. In such a device configuration, heat from a heating element may be conveyed almost instantaneously to at least a portion of the aerosol-forming substrate when the heating element is actuated, and this may facilitate the rapid generation of an aerosol. Furthermore, the overall heating energy required to generate an aerosol may be lower than would be the case in a system where the aerosol-forming substrate does not directly contact a heating element and initial heating of the substrate occurs by convection or radiation. Where a heating element is in direct contact with an aerosol-forming substrate, the initial heating of portions of the substrate that are in contact with the heating element will be effected by conduction.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may comprise one or more components used to supply energy from a power supply to an aerosol-forming substrate to generate an aerosol.

An aerosol-generating device may be described as a heated aerosol-generating device, which is an aerosol-generating device comprising a heater. The heater is preferably used to heat an aerosol-forming substrate of an aerosol-generating article to generate an aerosol.

An aerosol-generating device may be an electrically heated aerosol-generating device, which is an aerosol-generating device comprising a heater that is operated by electrical power to heat an aerosol-forming substrate of an aerosol-generating article to generate an aerosol. An aerosol-generating device may be a gas-heated aerosol-generating device. An aerosol-generating device may be a smoking device that interacts with an aerosol-forming substrate of an aerosol-generating article to generate an aerosol that is directly inhalable into a user's lungs thorough the user's mouth.

As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

An aerosol-forming substrate may be solid or liquid and may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco.

As used herein, the terms 'aerosol-generating article' and 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable.

Preferably an aerosol-generating article is a heated aerosol-generating article, which is an aerosol-generating article comprising an aerosol-forming substrate that is intended to be heated rather than combusted in order to release volatile compounds that can form an aerosol. The aerosol formed by heating the aerosol-forming substrate may contain fewer known harmful constituents than would be produced by combustion or pyrolytic degradation of the aerosol-forming substrate. An aerosol-generating article may be, or may comprise, a tobacco stick.

The present specification provides a method of using an aerosol-generating device, an aerosol-generating device, and a kit comprising an aerosol-generating device as set out in this specification. Various embodiments are set out in this specification.

Thus, in one aspect the present specification may provide a method of using an aerosol-generating device that has a reusable heating element for heating an aerosol-forming substrate. The method comprises the steps of bringing the heating element into direct contact with the aerosol-forming substrate and raising the temperature of the heating element to a first temperature to heat the aerosol-forming substrate such that an aerosol is formed. The method then provides the steps of removing or withdrawing the heating element from contact with the aerosol-forming substrate and raising the temperature of the heating element to a second temperature sufficient to thermally liberate organic materials deposited on the heating element. The second temperature is a higher temperature than the first temperature. The thermal liberation may occur by a pyrolysis or carbonisation reaction.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, processed tobacco, homogenised tobacco, extruded tobacco and expanded tobacco. The solid aerosol-forming substrate may be in loose form, or may be provided in a suitable container or cartridge. For example, the aerosol-forming material of the substrate may be contained within a paper or wrap and have the form of a plug. Where an aerosol-forming substrate is in the form of a plug, the entire plug including any wrapping paper is considered to be the aerosol-forming substrate.

Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghettis, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In preferred embodiments, the aerosol-forming substrate is contained in a smoking article, for example a rod-shaped smoking article such as a cigarette. The smoking article is preferably of suitable size and shape to engage with the aerosol-generating device so as to bring the aerosol-forming substrate into contact with the heating element of the device. For example, the smoking article may have a total length between approximately 30 mm and approximately 100 mm. The smoking article may have an external diameter between approximately 5 mm and approximately 12 mm.

The terms upstream and downstream may be used to describe relative positions of elements or components of the smoking article. For simplicity, the terms "upstream" and "downstream" as used herein refer to a relative position along the rod of the smoking article with reference to the direction in which the aerosol is drawn through the rod.

The heating element may conveniently be shaped as a needle, pin, rod, or blade that may be inserted into a smoking article in order to contact the aerosol-forming substrate. The aerosol-generating device may comprise more than one heating element and in the following description reference to a heating element means one or more heating elements.

The temperature of the heating element can be raised to both the first temperature and to the second temperature. The temperature may be raised by any suitable method. For example, the temperature may be raised by conduction caused by contact with another heat source. The temperature may be raised by inductive heating caused by a fluctuating electromagnetic field. The temperature may be raised by resistive heating caused by passing an electric current through a conductive wire or resistive track. In one embodiment, the track may have a resistance between 0.5 and 5 ohms.

Preferably the heating element comprises a rigid electrically insulating substrate with an electrically conductive track or wire disposed on its surface. Preferably the size and shape of the electrically insulating substrate allow it to be inserted directly into an aerosol-forming substrate. If the electrically insulating substrate is not sufficiently rigid, the heating element may comprise a further reinforcement means. A current may be passed through the track or wire to heat the heating element and the aerosol-forming substrate.

It is preferable that the aerosol-generating device further comprises electronic circuitry arranged to control the supply of current to the heating element to control the temperature. The aerosol-generating device may also comprise means for sensing the temperature of the heating element. This may enable the electronic circuitry or control circuitry to raise the temperature of the heating element to both the first temperature and the second temperature. It is preferred that the first temperature is a temperature high enough to cause the evolution of volatile compounds from the aerosol-forming substrate and, thus, the formation of an aerosol. It is preferred that the first temperature is not high enough to burn the aerosol-forming substrate.

Preferably the first temperature is lower than about 375 degrees centigrade. For example the first temperature may be between 80 degrees centigrade and 375 degrees centigrade, for example between 100 degrees centigrade and 350 degrees centigrade. The length of time that the heating element is held at the first temperature may be fixed. For example, the first temperature may be maintained for a period of greater than 2 seconds, for example between 2 seconds and 10 seconds. The length of time that the heating element is held at the first temperature may be a variable. For example, the aerosol-generating device may comprise a sensor that determines when a user is drawing on the smoking article and the time may be controlled by the length of time that the user draws on the smoking article.

During a period in which the heating element is in contact with the aerosol-forming substrate, the heating element undergoes a thermal cycle during which it is heated to the first temperature and then cooled. The heating element is preferably cooler than the first temperature when it is removed from contact with the aerosol-forming substrate. During contact, particles of the aerosol-forming substrate may adhere to a surface of the heating element. Furthermore, volatile compounds and aerosol evolved by the heat from the heating element may become deposited on a surface of the heating element. Particles and compounds adhered to and deposited on the heating element may prevent the heating element from functioning in an optimal manner. These particles and compounds may also break down during use of the aerosol-generating device and impart unpleasant or bitter flavours to a user. For these reasons it is desirable to clean the heating element periodically.

It is preferred that the second temperature is a temperature high enough to thermally liberate organic compounds that are in contact with the heating element. The organic compounds may be any particles or compounds adhered to or deposited on a surface of the heating element during a period of contact between the heating element and a substrate.

Thermal liberation of organic compounds may occur by pyrolysis. Pyrolysis is a process in which chemical compounds decompose due to the action of heat. Organic compounds generally pyrolyse to form organic vapours and liquids, which in the present specification may migrate away from the heating element leaving it in a cleaned state.

It is preferred that organic materials deposited on the heating element are thermally liberated by raising the temperature of the heating element to about 430 degrees centigrade or greater. For example, the temperature may be raised to greater than 475 degrees centigrade or greater than 550 degrees centigrade. The temperature may be raised to higher temperatures such as greater than 600 degrees centigrade or greater than 800 degrees centigrade.

It is preferable that the heating element is held at the second temperature for a period of time to effect thermal liberation of organic compounds. For example, the heating element may be held at the second temperature for more than 5 seconds. Preferably, the heating element is held at the second temperature for a period of between 5 seconds and 60 seconds, for example between 10 seconds and 30 seconds.

Smoking articles for use with aerosol-generating devices comprise an amount of an aerosol-forming substrate. The aerosol-forming substrate may be consumed entirely during a single thermal cycle of the heating element. In one such an embodiment, the heater will be constantly on and the temperature will be regulated by the amount of energy provided to the heating element during operation. This may be the case, for example, if the heating element is maintained at the first temperature for the duration of the consumption of the smoking article. Alternatively, the heating element is repeatedly pulsed through thermal cycles to the first temperature and back. These pulses may occur simultaneously with periods when a user is drawing on the smoking article. A portion of aerosol is generated each time the temperature reaches the first temperature and aerosol generation ceases each time the heating element cools again. When no further aerosol is generated the smoking article has been consumed. Thus, there may be more than 5 or more than 10 or more than 15 thermal cycles in which the heating element is raised to the first temperature and then cooled before the smoking article is consumed.

A user may remove a consumed smoking article and replace it with a fresh, unconsumed, smoking article without performing the step of raising the temperature of the heating element to the second temperature. In other words, the user may consume more than one article before performing a cleaning step to thermally liberate organic materials from the heating element.

Thus, the temperature of the heating element may be raised to the first temperature a plurality of times before the step of raising the heating element to the second temperature is carried out.

The step of raising the temperature of the heating element to the second temperature to thermally liberate organic materials adhered to or deposited on the heating element may be termed a cleaning step.

The cleaning step may be actuated manually by a user. For example, a user may decide that the heating element needs to be cleaned and actuate a cleaning cycle in which the heating element is raised to the second temperature for a predetermined period of time. Actuation may be effected by pressing a button on the aerosol-generating device. Preferably, the cleaning cycle is terminated automatically after a predetermined or pre-programmed thermal cycle.

The aerosol-generating device may comprise a sensing means to determine whether or not a smoking article is engaged with the aerosol-generating device. If a smoking article is engaged, preferably the aerosol-generating means comprises control means, for example control software that acts to prevent the heating element being heated to the second temperature, thereby preventing the cleaning cycle from being actuated while a smoking article is engaged with the aerosol-generating device.

The cleaning step may be actuated automatically. For example, the aerosol-generating device may comprise means for detecting when the heating element is removed from contact with the aerosol-forming substrate, for example when a smoking article is removed from the device. When such an event is detected the heating element may automatically be cycled through a cleaning regime in which the heating element is heated to the second temperature for a period of time.

Control means associated with the aerosol-generating device may record the number of smoking articles consumed by a user and automatically trigger a cleaning cycle after a predetermined number of smoking articles have been consumed.

In some embodiments, an aerosol-generating device may comprise a battery to provide energy for heating the heating element. It may be advantageous if the aerosol-generating device is associated with a docking station for re-charging the battery and for other functions. It may be advantageous that a cleaning cycle is triggered when the aerosol-generating device is docked in a docking station. The docking station may be able to supply more power to the heating element than the aerosol-generating device, and the second temperature may, therefore, be higher. A higher second temperature may result in a more efficient or faster cleaning process.

In one aspect the specification may provide an aerosol-generating device comprising a heating element coupled to a controller. The controller is programmed to actuate the heating element through a first thermal cycle in which the temperature of the heating element is raised to a first temperature lower than about 400 degrees centigrade in order to produce an average temperature of 375 degrees centigrade over the heating element surface and a maximum temperature anywhere on the surface, i.e., a maximum localized temperature, of 420 degrees centigrade. This allows an aerosol to be formed from an aerosol-forming substrate disposed in proximity to the heating element without burning the aerosol-forming substrate. The controller is further programmed to actuate the heating element through a second thermal cycle in which the temperature of the heating element is raised to a second temperature higher than about 430 degrees centigrade in order to thermally liberate organic material deposited on the heating element.

Preferably the first temperature is greater than 80 degrees centigrade. For example the first temperature may be between 80 degrees centigrade and 375 degrees centigrade, or between 100 degrees centigrade and 350 degrees centigrade.

The aerosol-generating device may be any device for performing a method described above. For example, the aerosol-generating device may be any device comprising a controller programmed to perform a method described above or defined in the claims.

The controller may be housed by the aerosol-generating device. Alternatively the controller may be housed within a docking station that is couplable to the aerosol-generating device and thereby to the heating element of the aerosol-generating device.

In one aspect the specification may provide a kit comprising an aerosol-generating device suitable for receiving a smoking article and comprising a heating element, the kit further comprising instructions to clean the heating element by thermally liberating organic material adhered to or deposited on the heating element. The instructions may describe how to thermally liberate organic material, for example by heating. The instructions may describe how a user should activate an automatic cleaning cycle programmed into the aerosol-generating device.

A kit may comprise a docking station that is couplable to the aerosol-generating device. The instructions may describe how a user should activate an automatic cleaning cycle programmed into the docking station.

A kit may further comprise one or more smoking articles. A kit may include instructions to carry out any method described above or defined in the claims.

Features described in relation to one aspect of the specification may also be applicable to other embodiments discussed herein.

Exemplary Embodiments

Exemplary embodiments will now be described with reference to the figures, in which.

Figure 1:
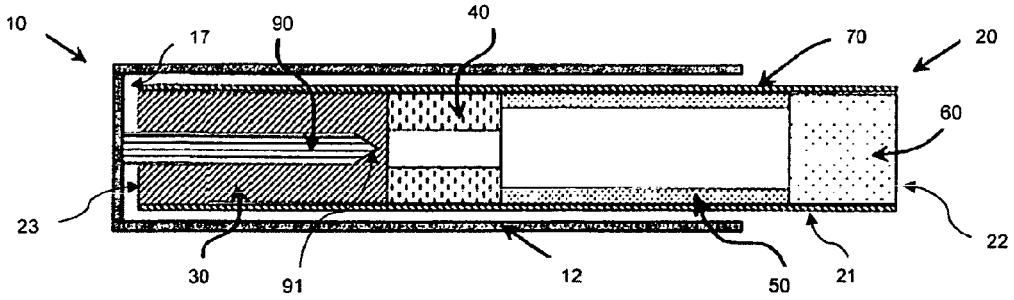
FIG. 1 is a schematic cross-sectional diagram of a first embodiment of an aerosol-generating device engaged with a smoking article.

FIG. 1 illustrates a portion of an aerosol-generating device 10 according to a first embodiment. The aerosol-generating device 10 is engaged with a smoking article 20 for consumption of the smoking article 20 by a user.

The smoking article 20 comprises four elements, an aerosol-forming substrate 30, a hollow tube 40, a transfer section 50, and a mouthpiece filter 60. These four elements are arranged sequentially and in coaxial alignment and are assembled by a cigarette paper 70 to form a rod 21. The rod has a mouth-end 22, which a user inserts into his or her mouth during use, and a distal end 23 located at the opposite end of the rod to the mouth end 22. Elements located between the mouth-end 22 and the distal end 23 can be described as being upstream of the mouth-end or, alternatively, downstream of the distal end.

When assembled, the rod 21 is 45 millimetres long and has a diameter of 7.2 millimetres.

The aerosol-forming substrate 30 is located upstream of the hollow tube 40 and extends to the distal end 23 of the rod 21. The aerosol-forming substrate comprises a bundle of crimped cast-leaf tobacco wrapped in a filter paper (not shown) to form a plug. The cast-leaf tobacco includes additives, including glycerine as an aerosol-forming additive.

The hollow tube 40 is located immediately downstream of the aerosol-forming substrate 30 and is formed from a tube of cellulose acetate. The tube 40 defines an aperture having a diameter of 3 millimetre. One function of the hollow tube 40 is to locate the aerosol-forming substrate 30 towards the distal end 23 of the rod 21 so that it can be contacted with a heating element. The hollow tube 40 acts to prevent the aerosol-forming substrate 30 from being forced along the rod towards the mouth-end 22 when a heating element is inserted into the aerosol-forming substrate 30.

The transfer section 50 comprises a thin-walled tube of 18 millimetres in length. The transfer section 50 allows volatile substances released from the aerosol-forming substrate 30 to pass along the rod 21 towards the mouth end 22. The volatile substances may cool within the transfer section to form an aerosol.

The mouthpiece filter 60 is a conventional mouthpiece filter formed from cellulose acetate, and having a length of 7.5 millimetres.

The four elements identified above are assembled by being tightly wrapped within a cigarette paper 70. The paper in this specific embodiment is a standard cigarette paper having standard properties or classification. The paper in this specific embodiment is a conventional cigarette paper. For example, the paper may be a porous material with a non-isotropic structure comprising cellulose fibers (crisscross s of fibers, interlinked by H-bonds), fillers and combustion agents. The filler agent may be CaCO3 and the burning agents can be one or more of the following: K/Na citrate, Na acetate, MAP (mono-ammonium phosphate), DSP (di-sodium phosphate). The final composition per squared meter may be approximately 25 g fiber+10 g Calcium carbonate, +0.2 g burning additive. The porosity of the paper may be between 0 to 120 coresta. The interface between the paper and each of the elements locates the elements and defines the rod 15 of the smoking article 1.

The interface between the paper and each of the elements locates the elements and defines the rod 21 of the smoking article 20. Although the specific embodiment described above and illustrated in FIG. 1 has five elements assembled in a cigarette paper, it will now be clear to one of ordinary skill in the art that a smoking article according to the embodiments discussed here may have additional elements and these elements may be assembled in an alternative cigarette wrapper or equivalent. Likewise, a smoking article according to the invention may have fewer elements. Moreover, if will now be apparent to one of ordinary skill in the art that various dimensions for the elements discussed in relation to the various embodiments discussed here are merely exemplary, and that suitable, alternative dimensions for the various elements may be chosen without deviating from the spirit of the embodiments discussed herein.

The aerosol-generating device 10 comprises a sheath 12 for receiving the smoking article 20 for consumption. A heating element 90 is located within the sheath 12 and positioned to engage with the distal end 23 of the smoking article. The heating element 90 is shaped in the form of a blade terminating in a point 91.

As the smoking article 20 is pushed into the sheath 12 the point 91 of the heating element 90 engages with the aerosol-forming substrate 30. By applying a force to the smoking article, the heating element 90 penetrates into the aerosol-forming substrate 30. Once properly located, further penetration is prevented as the distal end 23 of the smoking article 20 abuts an end wall 17 of the sheath 12, which acts as a stop.

When the smoking article 20 is properly engaged with the aerosol-generating device 10, the heating element 90 has been inserted into the aerosol-forming substrate 30.

Figure 2:
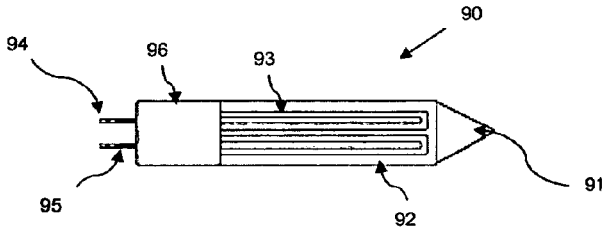
FIG. 2 is a schematic diagram illustrating a heating element of the first embodiment of an aerosol-generating device.

FIG. 2 illustrates a heating element 90 as comprised in the aerosol-generating device 10 of FIG. 1 in greater detail. The heating element 90 is substantially blade-shaped. That is, the heating element has a length that in use extends along the longitudinal axis of a smoking article engaged with the heating element, a width and a thickness. The width is greater than the thickness. The heating element 90 terminates in a point or spike 91 for penetrating a smoking article 20. The heating element comprises an electrically insulating substrate 92, which defines the shape of the heating element 90. The electrically insulating material may be, for example, alumina ($Al_2O_3$), stabilized zirconia ($ZrO_2$). It will now be apparent to one of ordinary skill in the art that the electrically insulating material may be any suitable electrically insulating material and that many ceramic materials are suitable for use as the electrically insulating substrate.

Tracks 93 of an electrically conductive material are plated on a surface of the insulating substrate 92. The tracks 93 are formed from a thin layer of platinum. Any suitable conductive material may be used for the tracks, and the list of suitable materials includes many metals, including gold, that are well known to the skilled person. One end of the tracks 93 is coupled to a power supply by a first contact 94, and the other end of the tracks 93 is coupled to a power supply by a second contact 95. When a current is passed through the tracks 93, resistive heating occurs. This heats the entire heating element 90 and the surrounding environment. When a current passing through the tracks 93 of the heating element 90 is switched off, there is no resistive heating and the temperature of the heating element 90 is swiftly lowered.

Heater element 90 also includes collar 96. The collar 96 may be formed of a suitable material that allows for conduction of electricity, so long as the design of the collar 96 is also selected to minimize resistive heating. In one embodiment, when the tracks 93 are formed of platinum or a platinum alloy, the collar 96 may be formed of gold or silver, or an alloy including either. Because of the difference in the electrical resistivity of the collar 96 material, less heat is generated over the collar area and the collar 96 sees a lower average temperature than the portion of heater element 90 including tracks 96. In another embodiment, the collar 96 may be formed of an insulating material, such as a ceramic or other appropriate insulator.

Collar 96 provides a cold zone as compared to the average surface temperature of the portion of heater element 90 that includes tracks 93. For example, the average temperature of the cold zone may be greater than 50 degrees centigrade cooler than the average surface temperature of the portion of heater element 90 including the tracks 93 during operation. Including the collar 96 may provide a number of benefits including that it reduces the temperature seen by any on-board electronics. In addition, collar 96 protects against the melting or degradation of various portions of device 10, when materials such as plastic are used in the device. The collar also reduces condensation at the distal end of the device because such aerosol is cooled as it passes over the collar 96. This reduction of condensation seen by electronics (not show) and contacts 94 and 95 included in the device 10 helps protect such elements.

The aerosol-generating device 10 comprises a power supply and electronics (not shown) that allow the heating element 90 to be actuated. Such actuation may be manually operated or may occur automatically in response to a user drawing on the smoking article. When the heating element is actuated, the aerosol-forming substrate is warmed and volatile substances are generated or evolved. As a user draws on the mouth end of the smoking article 20, air is drawn into the smoking article and the volatile substances condense to form an inhalable aerosol. This aerosol passes through the mouth-end 22 of the smoking article and into the user's mouth.

Figure 5:
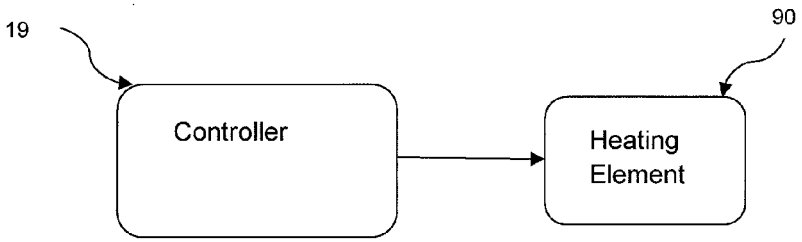
FIG. 5 is a block diagram illustrating the configuration of an aerosol-generating device.

In a specific embodiment (schematically illustrated in FIG. 5) an aerosol-generating device comprises a processor or controller 19 coupled to a heating element 90 to control heating of the heating element. The controller 19 is programmed to actuate the heating element through a first thermal cycle in which the temperature of the heating element is raised to a first temperature of 375 degrees centigrade. This allows the formation of an aerosol from an aerosol-forming substrate disposed in proximity to the heating element. The controller is further programmed to actuate the heating element through a second thermal cycle in which the temperature of the heating element is raised to a second temperature of 550 degrees centigrade for a period of 30 seconds. This allows organic material deposited on the heating element to decompose or pyrolyse.

Figure 4:
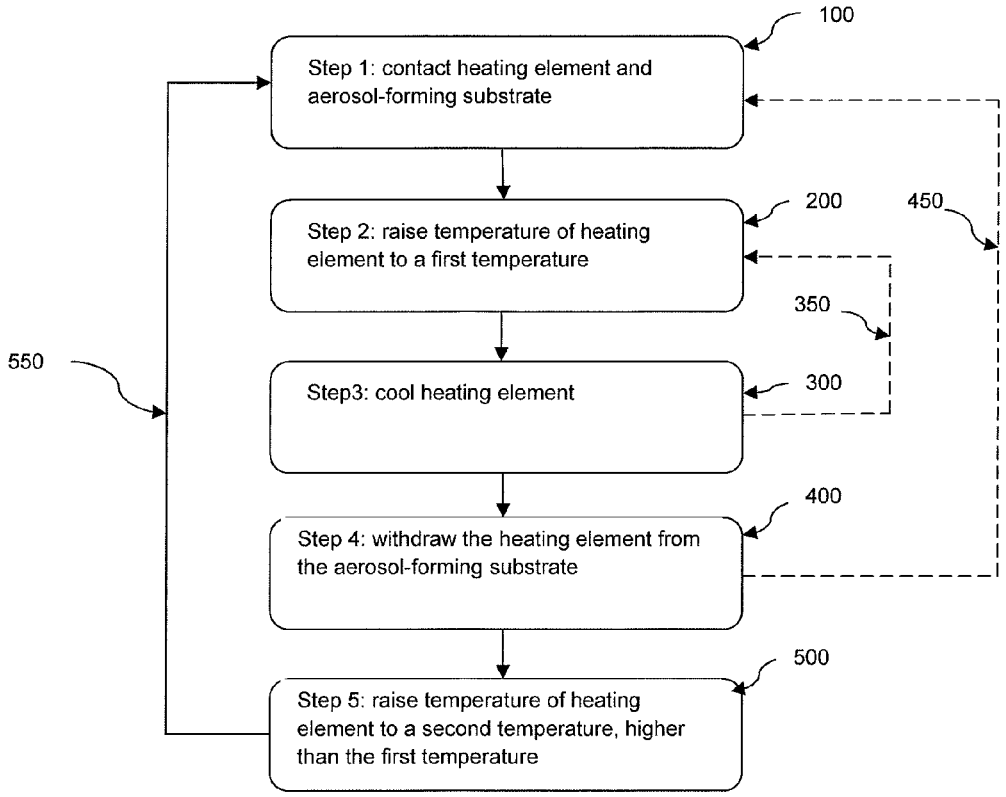
FIG. 4 is a flow diagram illustrating a first embodiment of a method.

A specific embodiment of a method of using an aerosol-generating device will now be described with reference to FIGS. 1 and 4. FIG. 4 is a flow diagram setting out the steps carried out in an embodiment of the inventive method.

Step 1—(Reference numeral 100 in FIG. 4): A heating element 90 of an aerosol-generating device 10 is brought into contact with an aerosol-forming substrate 30 contained within a smoking article 20. In order to achieve this, the smoking article 20 is inserted into a sheath 12 of the aerosol-generating device 10. A heating element 90 is located within the sheath 12, and projects from a bottom surface 17 of the sheath 12 such that it may be inserted into any smoking article that is received in the sheath. As the smoking article 20 is slid into the sheath 12, a tip or point 91 of the heating element 90 contacts a distal end 23 of the smoking article. Further movement of the smoking article towards the bottom end 17 of the sheath causes the heating element 90 to penetrate into an aerosol-forming substrate located at the distal end 23 of the smoking article 20. Once the smoking article has been fully inserted into the sheath, the distal end 23 of the smoking article abuts the bottom surface 17 of the sheath 12 and the heating element has reached maximum penetration.

Step 2: (Reference numeral 200) As the user draws or puffs on a mouth end 22 of the smoking article 20, sensors in the aerosol-generating device 10 may detect this event. In the event of detecting a user puffing or drawing, a controller 19 sends instructions that activate the heating element to heat to a first temperature. A current is passed through conductive tracks 93 disposed on the heating element, which results in resistive heating of the heating element. The first temperature is 375 degrees centigrade, which is sufficient to liberate volatile compounds from the aerosol-forming substrate 20. These volatile compounds condense to form an inhalable aerosol, which is drawn through the smoking article and into a user's mouth. Alternatively, a continuous heating may be used during operation of device 10 and detection of a user puffing or drawing may be used to trigger heating to compensate for any temperature drop of heater element 90 during the user puffing or drawing.

Step 3: (Reference numeral 300) When the user stops drawing or ends his puff on the mouth end 22 of the smoking article 20, sensors in the aerosol-generating device detect this event. The controller 19 sends instructions to switch off the current passing through the heating element 90. This stops the resistive heating of the tracks 93, and the temperature of the heating element is swiftly lowered. As the temperature is lowered, aerosol stops being generated. Alternatively, during the continuous heating discussed above, the controller 19 may instead simply reduce the amount of energy seen during the user puffing or drawing, based on a desired set point temperature.

If the aerosol-forming substrate 30 still contains volatile compounds, the user may take another puff on the smoking article 20 and repeat step 2 (indicated by arrow 350 in FIG. 4). Steps 2 and 3 may be repeated as often as necessary to consume the smoking article.

Step 4: (Reference numeral 400) When the user has finished with the smoking article 20, for example when no more aerosol is generated on heating the aerosol-forming substrate 30, the smoking article 20 is removed from the sheath 12 of the aerosol-generating apparatus 10. This means that the heating element 90 is removed from contact with the aerosol-forming substrate 30. Almost inevitably, the heating element 90 will have become soiled with some deposits or residues derived from the aerosol-forming substrate 30. Such deposits may impair performance of the heating element. For example, deposits on the heating element may inhibit thermal transfer between the heating element and the aerosol-forming substrate. Deposits on a heating element may also inhibit temperature sensing when the heating element is utilized to sense temperature. Deposits on a heating element may also generate bitter compounds on repeated heating, which may impair the flavour of aerosols generated when consuming subsequent smoking articles.

If a user feels that the deposits on the heating element are at a sufficiently low level, he may decide to consume a further smoking article. In this case, steps 1 to 4 may be repeated. This is indicated by the arrow 450 in FIG. 4.

Step 5: (Reference numeral 500) If a user believes that the heating element is in need of cleaning, he then presses a button (not shown) on the aerosol-generating device 10 that causes the controller to activate a cleaning cycle. During the heating cycle, current is passed through the tracks 93 of the heating element 90 to raise the temperature of the heating element to a second temperature. This second temperature is 550 degrees centigrade, a temperature at which deposits on the heating element can thermally degrade or pyrolyse. The heating element 90 is held at a temperature of 550 degrees centigrade for a period of 30 seconds to thermally liberate the organic compounds deposited on the heating element 90.

Figure 3:
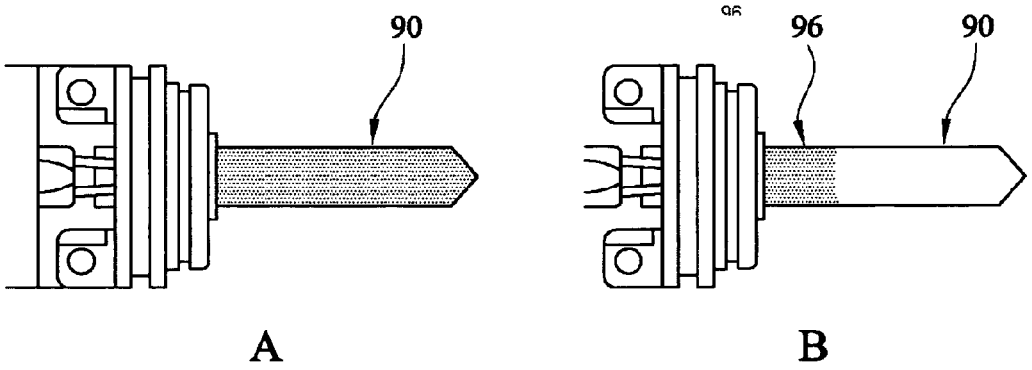
FIG. 3A is an illustration showing a heating element of the first embodiment of an aerosol-generating device with a surface that has been soiled with organic components.
FIG. 3B is an illustration showing the heating element of FIG. 3A after the organic components have been thermally liberated.

FIG. 3A illustrates a portion of an aerosol-generating device. This figure illustrates a heating element 90 after use of the device to consume a smoking article. That is, FIG. 3A illustrates a heating element 90 of an aerosol-generating device after step 4 of the method described above. It can be seen that the heating element 90 is coated in organic deposits, which appear to be black in FIG. 3A.

FIG. 3B illustrates the same heating element as illustrated in FIG. 3A after the performance of a cleaning cycle as described by step 5 above. That is, the heating element 90 of FIG. 3A has been heated to a temperature of 550 degrees centigrade and held at that temperature for a period of 30 seconds. It can be seen that the black deposits visible in FIG. 3A have been removed and the heating element has been cleaned. In FIG. 3B, the heating element now has a shiny appearance where the organic deposits have been removed.

After cleaning, the aerosol-generating device is ready for use. Steps 1 to 5 may be repeated. This is indicated by the arrow 550 in FIG. 4.

In the embodiment of a method described above, the step of heating the heating element to a first temperature to produce an aerosol occurred when the device detected a user taking a puff. In other embodiments, a user may manually activate the heating element to produce an aerosol.

In the embodiment of a method described above, the step of initiating a cleaning cycle was manually activated. In other embodiments, a cleaning cycle may be automatically triggered every time a smoking article is removed from the aerosol-generating device.

Figure 6:
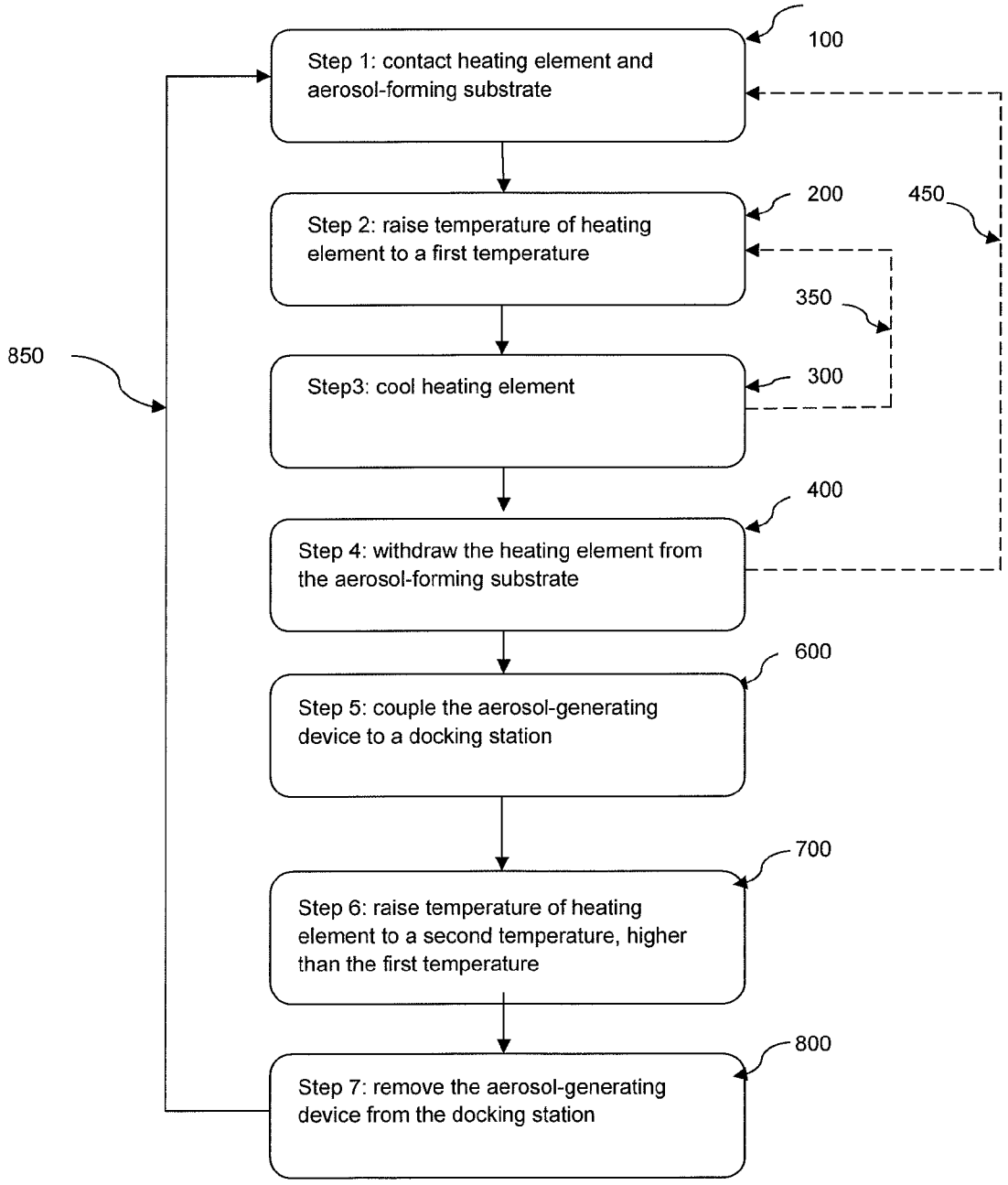
FIG. 6 is a flow diagram illustrating a second embodiment of a method.

The aerosol-generating device 10 may be used in conjunction with a docking station (not illustrated). A docking station may be used, for example, to recharge batteries used to power the aerosol-generating device. FIG. 6 illustrates an embodiment of a method that may be used when the aerosol-generating device coupled to a docking station.

Steps 1 to 4 are the same as described above in relation to FIG. 4. FIG. 6 uses the same reference numerals for steps that are the same as previously described.

Step 5: (Reference numeral 600) The aerosol-generating device 10 is coupled to a docking station (not shown) for receiving the device.

Step 6: (Reference numeral 700) When the aerosol-generating device 10 is detected, a controller activates a cleaning cycle. During the heating cycle, current is passed through tracks 93 of the heating element 90 to raise the temperature of the heating element to a second temperature. This second temperature is 550 degrees centigrade, a temperature at which deposits on the heating element can thermally degrade or pyrolyse. The heating element 90 is held at a temperature of 550 degrees centigrade for a period of 30 seconds to thermally liberate the organic compounds deposited on the heating element 90. In one embodiment, the controller may be triggered from a signal from the docking station indicating that the device has not been cleaned after a predetermined number of uses, e.g., the user has contacted the heating element 90 with 10 or more times without performing a cleaning cycle. The controller 19 may then force the user to perform a cleaning cycle. For example, the user may be prohibited from activating heater element 90 unless a cleaning cycle is first performed. Controller 19 itself may contain instructions for locking the device 10 or the docking station may maintain information regarding use and provide the locking and unlocking instructions to the controller 19.

Step 7: (Reference numeral 800) The aerosol-generating device is removed from the docking station. The aerosol-generating device is ready for use. Steps 1 to 7 may be repeated. This is indicated by the arrow 850 in FIG. 6.

The exemplary embodiments described above illustrate but do not limit the invention. In view of the above discussed exemplary embodiments, other embodiments consistent with the above exemplary embodiments will now be apparent to one of ordinary skill in the art.

The invention claimed is:

1. A method of using an aerosol-generating device having a reusable heating element, comprising:

bringing the heating element into direct contact with an aerosol-forming substrate by inserting the heating element into a smoking article comprising the aerosol-forming substrate;

raising a temperature of the heating element to a first temperature to heat the aerosol-forming substrate sufficiently for an aerosol to be formed;

removing the heating element from the direct contact with the aerosol-forming substrate; and raising the temperature of the heating element to a second temperature, higher than the first temperature, to thermally liberate organic materials adhered to or deposited on the heating element.

2. The method of using an aerosol-generating device according to claim 1, in which the organic materials deposited on the heating element are thermally liberated by raising the temperature of the heating element to the second temperature of greater than about 430 degrees cenfigrade.

3. The method of using an aerosol-generating device according to claim 1, in which the heating element is held at the second temperature for a period of between 5 seconds and 60 seconds.

4. The method of using an aerosol-generating device according to claim 1, in which the aerosol-forming substrate comprises tobacco.

5. The method of using an aerosol-generating device according to claim 1, in which an aerosol is formed as a result of heating the heating element to an average first temperature of between 80 degrees centigrade and 375 degrees centigrade with a nmaximum localized temperature limit of 420 degrees centigrade while in contact with the aerosol-forming substrate.

6. The method of using an aerosol-generating device according to claim 1, in which the step of raising the temperature of the heating element to a first temperature to heat the aerosol-fonning substrate sufficiently to fonii an aerosol is performed two or more times prior to the step of raising the temperature of the heating element to a second temperature, higher than the first temperature, to thermally liberate organic materials adhered to or deposited on the heating element.

7. The method of using an aerosol-generating device according to claim 1, in which the step of raising the temperature of the heating element to a second temperature, higher thanthe first temperature, to thermally liberate organic materials adhered to or deposited on the heating element, occurs in response to a trigger actuated by a user.

8. The method of using an aerosol-generating device according to claim 1, in which the aerosol-generating device is coupleable to a docking station, in which the step of raising the temperature of the heating element to a second temperature, higher than the first temperature, to thermally liberate organic materials adhered to or deposited on the heating element occurs when the aerosol-generating device is coupled to the docking station.

9. The method of using an aerosol-generating device according to claim 1, further comprising a step of cooling the heating element a temperature below the first temperature before the step of removing the heating element from the direct contact with the aerosol-forming substrate.

* * * * *